United States Patent [19]

Gafken

[11] Patent Number: 4,542,936

[45] Date of Patent: Sep. 24, 1985

[54] CHIROPRACTOR'S EXAMINATION STOOL

[76] Inventor: David M. Gafken, 1314 S. Main St., Auburn, Ind. 46706

[21] Appl. No.: 493,474

[22] Filed: May 11, 1983

[51] Int. Cl.[4] ..... A47C 3/20; A47C 15/00

[52] U.S. Cl. ..... 297/257; 108/95; 108/105; 297/240

[58] Field of Search ..... 297/240, 241, 257; 108/94, 95, 103, 105, 140, 141

[56] References Cited

U.S. PATENT DOCUMENTS

| | | | |
|---|---|---|---|
| 689,964 | 12/1901 | Heiber | 297/240 |
| 1,256,279 | 2/1918 | Wanamaker | 248/188.91 |
| 2,553,545 | 5/1951 | Booth | 297/240 |
| 2,961,260 | 11/1960 | Newlin | 403/104 |
| 3,312,432 | 4/1967 | Pfeiffer et al. | 248/188.91 |
| 3,599,962 | 8/1971 | Henry | 297/172 X |
| 3,770,236 | 11/1973 | Marsh et al. | 248/408 |
| 4,043,276 | 8/1977 | Dahl | 108/94 X |

*Primary Examiner*—William E. Lyddane
*Assistant Examiner*—Peter R. Brown
*Attorney, Agent, or Firm*—George A. Gust

[57] ABSTRACT

A doctor-patient seating arrangement as might for example be used by a chiropractor during examination of a patient's back is disclosed in a form having a single base or pedestal from which a pair of upright seat support members extend with each upright member providing a degree of vertical adjustability to its respective supported seat. The seats themselves are of the backless variety, i.e., stools with the patient's stool being swivelable centrally about its upright support member while the doctor's stool is supported on an obliquely extending arm so as to be movable in an arc around the other upright support member. The other upright support member is located near the patient's back so that the doctor may move in an arc about the patient examining the sides as well as the central portion of the patient's back. The adjustment range of the patient's stool is elevated somewhat above the adjustment range of the doctor's stool so that the doctor is properly positioned to examine the patient regardless of the particular physical traits of doctor or patient.

8 Claims, 5 Drawing Figures

CHIROPRACTOR'S EXAMINATION STOOL

BACKGROUND OF THE INVENTION

1. Field of the Invention

The present invention relates generally to adjustable height stool arrangements and more particularly to a dual stool configuration for the tandem seating of a doctor and patient.

2. Description of the Prior Art

The conventional technique for patient examination in a chiropractic office is for the patient to lay on a conventional chiropractor's table with the doctor straddling that table during examination. Such a technique is both awkward and tiring for the doctor particularly when the doctor examines a large number of patients each day. Examination techniques with the patient in a vertical attitude have not met with widespread acceptance since this technique requires that the patient's head be elevated somewhat above that of the doctor resulting in an inconvenient or uncomfortable position for one or the other. Further, neither the conventional chiropractor's table nor the heretofore attempted vertical attitude examination schemes allowed the doctor to maintain an unawkward and comfortable position while at the same time providing him with the requisite mobility for a complete examination. It would be highly desirable to provide a relatively economical yet extremely sturdy tandem seating examination arrangement and particularly such an arrangement which was adjustable independently for doctor and patient and capable of comfortably locating the doctor relative to the patient in an easily selectable relative position.

SUMMARY OF THE INVENTION

Among the several objects of the present invention may be noted the achievement of the aforementioned goals and avoidance of the aforementioned deficiencies; the provision of a tandem examination arrangement which comfortably accommodates both doctor and patient while facilitating the doctor's examination of the patient; the provision of a doctor-patient seating arrangement which allows the doctor to pivot about an axis closely adjacent the patient's back; and the provision of a dual stool doctor-patient examination arrangement wherein the patient's head is elevated somewhat above that of the doctor and the doctor may freely move around a limited arc to inspect the sides as well as the center of the patient's back while both remain seated. These as well as other objects and advantageous features of the present invention will be in part apparent and in part pointed out hereinafter.

In general, a tandem examination stool arrangement includes a pair of adjustable elevation stools supported on a common pedestal with the patient's stool being fixed relative to a central axis and the doctor's stool being pivotable about a vertical axis which lies intermediate the doctor and patient seating positions.

Also in general and in one form of the invention, a seating arrangement includes a unitary base with first and second upright seat support members affixed thereto with one stool supported in vertical alignment with the first support and another stool laterally spaced from the second support with an oblique seat support arm interconnecting the second stool and second upright support member in a pivotal arrangement about the axis of the support member. Preferably the vertical seat support member allow independent adjustment of the elevations of the two stools within ranges with the maximum elevation of the stool to receive a patient exceeding a maximum elevation of the doctor's stool.

BRIEF DESCRIPTION OF THE DRAWINGS

Corresponding reference characters indicate corresponding parts throughout the several views of the drawing.

Figure 1:
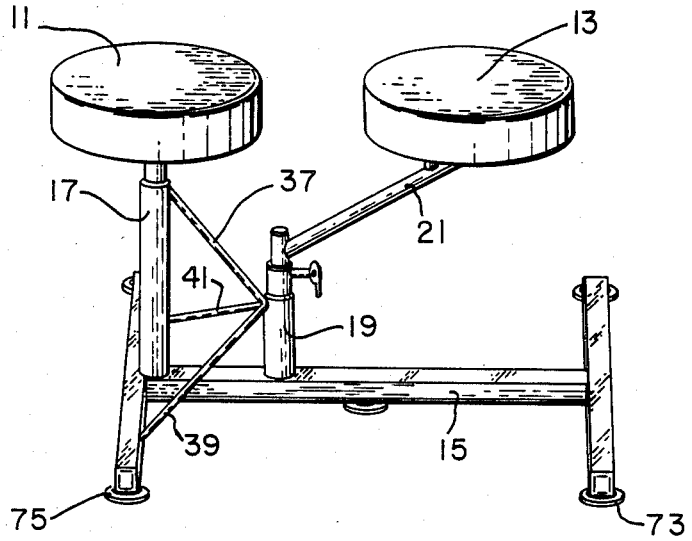
FIG. 1 is a perspective view of a dual stool arrangement according to the present invention with both stools in their lower most positions.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Referring to the drawings generally, the doctor-patient seating arrangement of the present invention includes a first padded backless seat or stool 11 for seating a patient and a second stool 13 for seating a doctor during examination of the patient. The two stools 11 and 13 are supported on a common pedestal which includes an "H" shaped base 15, upright seat support members 17 and 19 and an oblique seat support arm 21. Stool 11 is fixed with respect to the axis of the upright member 17 while stool 13 is free to execute an arc about the axis of the upright support member 19 with both stools being vertically adjustable as can be seen by comparing FIGS. 1 and 4. In use, the doctor would be seated on stool 13 while the patient is seated on stool 11, both facing toward the left as viewed in FIG. 1, and preferably with the patient's head elevated somewhat above that of the examining doctor. The mechanisms employed to vertically adjust the stools 11 and 13, diagonal bracing and other features of the dual stool pedestal arrangement are perhaps best illustrated in FIG. 2.

Figure 2:
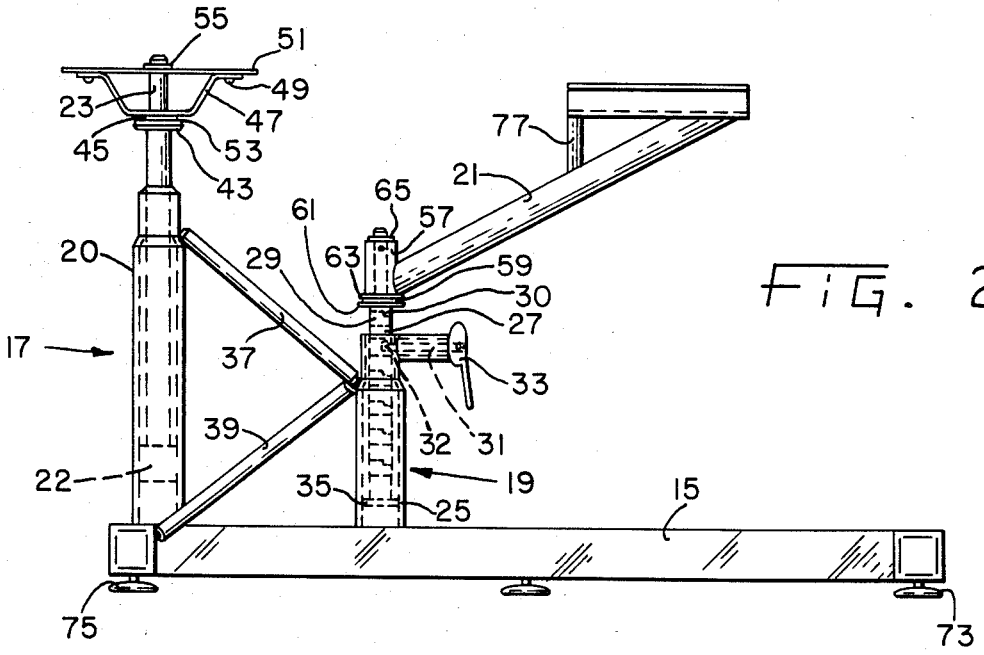
FIG. 2 is a side elevation view illustrating the pedestal details and elevation adjusting techniques of the present invention.

Referring now to FIG. 2, the upright support member 17 for supporting the patient's stool 11 may be of the type which provides a continuous adjustment throughout its range, for example, as disclosed in U.S. Pat. Nos. 2,872,223 and 2,961,260. Briefly, this arrangement allows the stool 11 to be raised to a desired height and then a slight downward pressure thereon causes a clutching mechanism 22 to engage the inner side walls of an outer post or tube 20 of the telescoped pair of tubes 20 and 23 holding post 23 at the desired elevation. Raising to stool to its upper extreme causes release of the clutching mechanism 22 and the stool may be lowered to its lower extreme and the process repeated. On the other hand, upright support member 19, which supports the doctor's stools 13, may be of the variety providing selectable discrete steps of adjustment, as for example disclosed in U.S. Pat. No. 3,770,236. Briefly, this adjusting arrangement employs inner and outer telescopically nested posts 25 and 27 with a series of cross-openings 29 for receiving a locking pin or plunger 31. In one preferred form, the openings 29 include a lip 30 and the locking pin 31 includes a protrusion 32 to insure that the release handle 33 is not accidentally actuated when the stool is in use. Guide rings 35 within the outer post or tube 25 are helpful in stabilizing the post 27.

The upright seat support member 17 and 19 are interconnected by diagonal brace members 37 and 39 with a further member 41 directly behind member 39 as viewed in FIG. 2. The diagonal braces 39 and 41 are welded to the "H" shaped pedestal base as better seen in FIG. 3 and extend diagonally upwardly to engage an upper portion of the post 25. Diagonal brace 37 extends further upwardly from the point of attachment of the diagonals 39 and 41 to engage an upper portion of the patient's support post 21. These diagonal members provide enhanced rigidity to the examination stool.

A swiveling or pivotal motion for the patient's stool 11 is provided by a washer 43 resting on an enlarged portion of the post 23 with a similar washer 45 supporting bracket 47 which is attached as by bolts or screws 49 to a portion 51 of the stool 11. Sandwiched between the washers 43 and 45 is a bearing ring 53 or, for example, a nylon material to provide a smooth low friction pivotal motion to the stool 11. A conventional snap ring 55 or similar arrangement may be provided to prevent the inadvertent removal of the stool 11 from post 23.

A somewhat similar pivotal motion is provided to the flange 57 which supports obliquely extending arm 21 extending toward the doctor's seat 13. Thus, a nylon bearing ring 59 is sandwiched between the washers 61 and 63 and the flange 57 held down on post 27 by a snap ring 65 or similar arrangement. The details of the base 15 of the pedestal arrangement are better understood by reference to FIG. 3.

Figure 3:
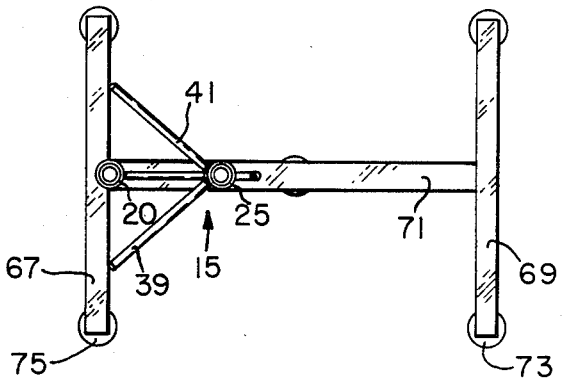
FIG. 3 is a plan view of the pedestal of the tandem seating arrangement of the present invention.

In FIG. 3, the base 15 is seen to include a generally "H" shaped frame of, for example, square tubular portions 67 and 69 having free ends and spanned near their middle portions by a further tubular portion 71. Floor engaging feet such as 73 and 75 are positioned one each near the "H" free ends and one near the center of the cross-member 71.

Figure 4:
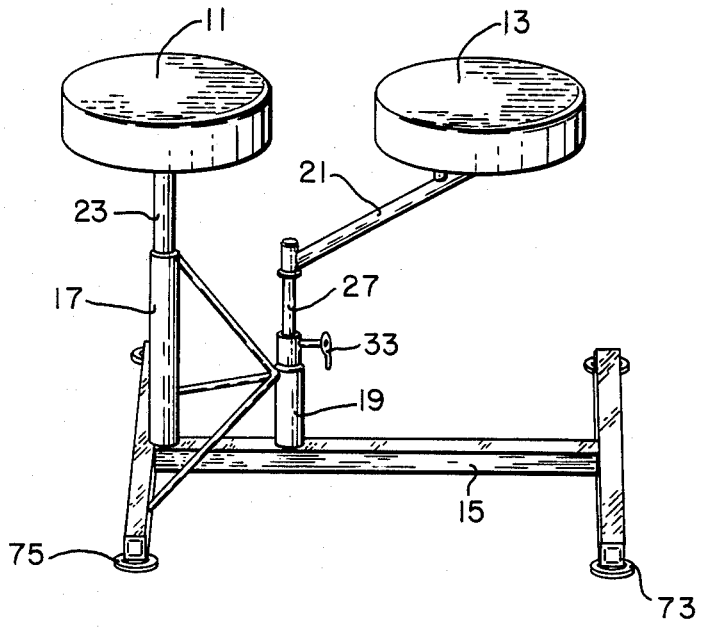
FIG. 4 is a view similar to FIG. 1 but illustrating the two stools at their maximum elevation.
Figure 5:
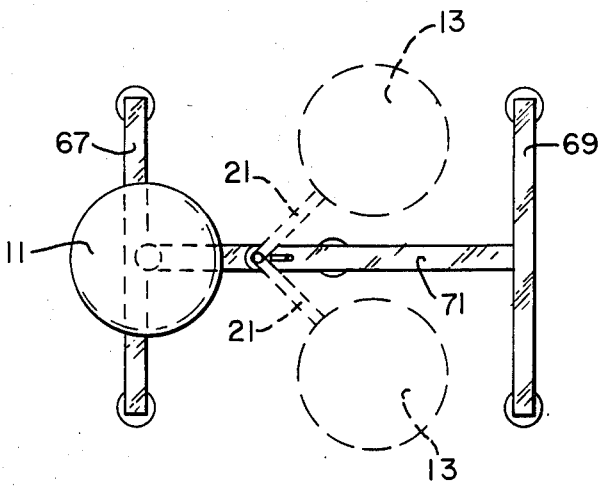
FIG. 5 is a simplified plan view of the doctor-patient seating arrangement illustrating the lateral mobility of the doctor's stool.

The upper extremes of adjustments of the stools 11 and 13 as illustrated in FIG. 4 with the inner posts 23 and 27 visible as compared to FIG. 1. For example, the stool 11 may have a range of adjustment of around eight (8) inches while stool 13 has an adjustment range of around six (6) inches in, for example, six discrete steps. From FIG. 4 it will be apparent that the head of a patient seated on stool 11 will be elevated above that of the doctor seated on stool 13, and referring to FIG. 5, it will be noted that the doctor's stool 13 pivots about the axis of the posts 27 and 25, allowing the doctor to examine the sides of a patient's back as well as the central portion thereof. The doctor's stool 13 could also be made to pivot about its own central axis, however, this has been found to typically be unnecessary and accordingly the stool 13 is fixed to the obliquely extending arm 21 and may include an upright brace member 77 if desired.

From the foregoing it is now apparent that a novel dual stool examination arrangement allowing the tandem seating of a doctor and patient and a wide range of adjustments to suit the doctor as well as allowing him to move freely about the patient has been disclosed meeting the objects and advantageous features set out hereinbefore as well as others, and that modifications as to the precise configurations, shapes and details may be made by those having ordinary skill in the art without departing from the spirit of the invention or the scope thereof as set out by the claims which follow.

What is claimed is:

1. A doctor-patient seating arrangement comprising:

a unitary base, formed as a generally H-shaped frame of tubular portions having five floor engaging feet, one each at the free ends of each arm of the H-shaped frame and one near the center of the cross-member of the H-shaped frame;

a first upright seat support member fixed to the base proximate to the intersection of one arm of the H-shaped frame and the cross-member of the H-shaped frame and extending upwardly therefrom;

a second upright seat support member fixed to the cross-member of the H-shaped frame and extending upwardly therefrom in a parallel spaced apart relationship with the first upright seat member;

a first post supported backless swivel seat upon which a patient may sit, the first seat vertically aligned with the first upright seat support member and including means for vertically adjusting and selecting a preferred seat height;

a second post supported backless movable seat upon which a doctor may sit while examining a seated patient, the second seat being laterally spaced apart from the second upright seat support member; and an oblique seat support arm immovably fixed, at one end thereof, to the second seat and including means, near an end opposite the seat, for vertically adjusting and pivotally attaching the support arm and second seat to the second upright seat support member at a second selected preferred elevation, the preferred height of the first seat and preferred elevation of the second seat being selectable for any particular doctor and any particular patient so that the doctor may be seated on the second seat with his head at a lower elevation than the head of the patient seated on the first seat;

wherein the second upright seat support member defines a vertical axis about which the second seat may be pivoted in a substantially horizontal plane, the separation between the first and the second upright seat support members being substantially the same as the lateral extent of the first seat in relation to the first upright seat support member so that the so defined vertical axis extends closely adjacent an edge of the first seat.

2. The seating arrangement of claim 1 wherein the means for selecting a preferred seat height of the first seat is continuously adjustable throughout a first range of heights and concurrently the means for pivotally attaching the oblique support arm and second seat is so adapted that the elevation of the second seat is selectable in discrete steps throughout a second range.

3. The seating arrangement of claim 2 wherein the highest position within the range for the first seat is above the highest elevation within the range for the second seat.

4. The seating arrangement of claim 1 further comprising:

diagonal brace means, extending from near opposite free ends of the arm of the H-shaped frame proximate to the first upright seat support member to the second upright seat support member near the top thereof, for supporting the second upright seat support member; and diagonal brace means, extending from the second upright seat support member near the top thereof to the first upright seat support member near the top thereof, for supporting the first upright seat support member with respect to the second upright seat support member.

5. The seating arrangement of claim 1, wherein the vertical extent of the first upright seat support member above the plane of the H-shaped base exceeds the vertical extent of the second upright seat support member with respect to said plane.

6. A dual stool doctor-patient examining arrangement wherein a doctor may sit on one stool in a position facing the back of a patient seated on the other stool and wherein the seated doctor may move freely around a limited arc to inspect the sides, as well as the center, of the patient's back, while both remain seated, the examining arrangement comprising:

a generally H-shaped horizontally extending frame supported by at least five floor engaging feet, one each located substantially at the free ends of each arm of the H-shaped frame and at least one centrally disposed therebetween on the cross-member of the H-shaped frame;

a pair of upright support members extending upwardly of the H-shaped frame and affixed thereto so as to define a first vertical pivot axis and a second vertical pivot axis, respectively, each support member being formed of two telescopically extensible members and including means to retain the members in a verticaly adjusted position;

a first adjustable elevation stool supported on the upright support member defining the first pivot axis, for receiving a patient, the first stool being swivelable about a central axis vertically aligned with the first pivot axis; and a second adjustable elevation stool, upon which a doctor may sit, supported obliquely from the upright support member defining the second pivot axis so as to be pivotable through an arc centered about the second upright support member when the first and second stools are disposed such that the second vertical axis is intermediate the doctor and patient seating positions;

the first and second stools being independently adjustable in elevation such that the highest position within the range of adjustability of the first stool is above the highest elevation within the range of adjustability of the second stool.

7. The arrangement of claim 6, wherein each of the pair of support members comprises:

a pair of concentric inner and outer posts; and means for axially locking the inner and outer posts of each pair together to provide desirable independent stool elevations.

8. The arrangement of claim 7, wherein the means for axially locking the inner and outer posts of the first upright support member together comprises a friction grip mechanism near a lower end of the inner post for selectively frictionally engaging an inner surface of the outer post, thereby enabling the elevation of the first stool to be continuably adjustable throughout its range; and wherein the means for axially locking the inner and outer posts of the second upright support member together comprises a plunger axially fixed on the outer post and spring biased radially inwardly thereof to enter a selected one of a plurality of axially spaced apart holes along the inner post, thereby enabling the elevation of the second stool to be adjusted in discrete steps of elevation throughout its range.

* * * * *